US010132077B2

(12) United States Patent
Schillinger

(10) Patent No.: US 10,132,077 B2
(45) Date of Patent: Nov. 20, 2018

(54) FAST CONSTRUCTION OF ENERGY-EFFICIENT BUILDINGS

(71) Applicant: Ervin Schillinger, Kfar Kish (IL)

(72) Inventor: Ervin Schillinger, Kfar Kish (IL)

(73) Assignee: Ervin Schillinger, Kfar Kish (IL)

( * ) Notice: Subject to any disclaimer, the term of this patent is extended or adjusted under 35 U.S.C. 154(b) by 0 days.

(21) Appl. No.: 15/854,899

(22) Filed: Dec. 27, 2017

(65) Prior Publication Data

US 2018/0223526 A1 Aug. 9, 2018

Related U.S. Application Data

(60) Provisional application No. 62/456,143, filed on Feb. 8, 2017.

(30) Foreign Application Priority Data

Jul. 3, 2017 (IL) ..... 253294

(51) Int. Cl.

| | |
|---|---|
| ***E04B 2/58*** | (2006.01) |
| ***E04B 1/24*** | (2006.01) |
| ***E04G 13/02*** | (2006.01) |
| ***E04F 13/14*** | (2006.01) |
| ***E04F 13/02*** | (2006.01) |

(Continued)

(52) U.S. Cl.

CPC ..... *E04B 2/58* (2013.01); *E04B 1/24* (2013.01); *E04B 1/40* (2013.01); *E04B 2/64* (2013.01); *E04F 13/02* (2013.01); *E04F 13/0805* (2013.01); *E04F 13/14* (2013.01);

(Continued)

(58) Field of Classification Search

CPC ..... E04B 1/24; E04B 1/40; E04B 2/58; E04B 2/64; E04B 2001/405; E04F 13/02; E04F 13/0805; E04F 13/14; E04G 11/06; E04G 13/02

See application file for complete search history.

(56) References Cited

U.S. PATENT DOCUMENTS 884,166 A * 4/1908 Kemper ..... E04G 9/10 249/189
1,107,486 A * 8/1914 Bragstad ..... 110/184

(Continued)

FOREIGN PATENT DOCUMENTS

CN 1958984 A 5/2007
CN 101845852 A 9/2010

(Continued)

OTHER PUBLICATIONS

International Application # PCT/IB2017/058437 search report dated Apr. 17, 2018.

*Primary Examiner* — James M Ference
(74) *Attorney, Agent, or Firm* — D. Kligler IP Services Ltd.

(57) ABSTRACT

Described embodiments include a method, including arranging one or more frames (22) and one or more boards (24), such that the frames, together with the boards, enclose a space (26). The method further includes pouring first concrete (28) into the space, and, after the first concrete solidifies, within the space, into a structure (42), removing the boards from the structure. The method further includes pouring second concrete (70) over the frames, such that the second concrete solidifies, over the frames, into respective walls that are adjacent to the structure. Other embodiments are also described.

28 Claims, 5 Drawing Sheets

(51) Int. Cl.

| | |
|---|---|
| ***E04F 13/08*** | (2006.01) |
| ***E04B 2/64*** | (2006.01) |
| ***E04B 1/41*** | (2006.01) |
| ***E04G 11/06*** | (2006.01) |
| *E04B 1/38* | (2006.01) |

(52) U.S. Cl.
CPC ..... *E04G 11/06* (2013.01); *E04G 13/02* (2013.01); *E04B 2001/405* (2013.01)

(56) References Cited

U.S. PATENT DOCUMENTS 1,902,271 A 4/1930 Warner
1,958,049 A * 5/1934 Kleitz ..... E04G 11/18 249/178
2,934,934 A * 5/1960 Berliner ..... E04C 2/06 52/309.17
3,559,355 A * 2/1971 Day, Jr. ..... E04B 1/161 52/251
3,730,475 A * 5/1973 Werfel ..... B28B 7/0038 249/13
4,263,765 A * 4/1981 Maloney ..... E04B 1/4185 52/173.1
4,454,702 A * 6/1984 Bonilla-Lugo ..... E04B 2/847 52/251
4,554,124 A * 11/1985 Sudrabin ..... E04B 1/04 264/261
4,566,238 A * 1/1986 Janopaul, Jr. ..... E04B 1/74 52/404.3
4,570,398 A * 2/1986 Zimmerman ..... E02D 31/02 52/169.11
4,573,303 A * 3/1986 Figari ..... E04B 5/263 264/35
4,603,527 A * 8/1986 Vercelletto ..... E04B 1/76 52/410
4,605,529 A * 8/1986 Zimmerman ..... B28B 19/003 264/250
4,669,240 A * 6/1987 Amormino ..... E04B 1/04 264/253
4,751,803 A * 6/1988 Zimmerman ..... B28B 19/003 52/309.12
4,998,393 A * 3/1991 Baena ..... E04B 1/161 52/236.9
5,058,345 A * 10/1991 Martinez ..... B21F 27/128 29/432
5,092,093 A * 3/1992 Lu ..... E04G 9/06 249/135
5,335,472 A * 8/1994 Phillips ..... E04B 2/845 52/259
5,845,441 A * 12/1998 Swartz ..... E04B 1/04 52/250
6,041,561 A * 3/2000 LeBlang ..... E04B 1/14 52/234
6,044,614 A * 4/2000 Bryant ..... E04G 11/08 249/34
6,148,576 A * 11/2000 Janopaul, Jr. ..... E04B 1/4178 52/379
6,260,320 B1 * 7/2001 Di Lorenzo ..... E04B 1/04 52/250
6,463,702 B1 * 10/2002 Weaver ..... E04B 1/04 52/236.9
6,550,215 B1 * 4/2003 Pulte ..... B28B 7/0082 249/159
6,698,150 B1 * 3/2004 DiLorenzo ..... E01F 8/0029 52/250
6,701,683 B2 * 3/2004 Messenger ..... E04C 2/044 52/309.11
6,729,090 B2 * 5/2004 Messenger ..... E04C 2/044 52/309.12
8,127,509 B2 * 3/2012 Propst ..... B32B 3/06 52/293.1
8,863,445 B2 * 10/2014 Zhong ..... E04B 1/165 52/79.14
9,157,234 B1 * 10/2015 Foster ..... E04B 2/8652
2002/0017598 A1 * 2/2002 Diorio ..... E04B 5/38 249/13
2003/0093965 A1 * 5/2003 Miller ..... E04B 5/046 52/600
2004/0016194 A1 * 1/2004 Stefanutti ..... E02D 27/02 52/425
2004/0065034 A1 * 4/2004 Messenger ..... E04C 2/044 52/309.11
2006/0137269 A1 * 6/2006 Di Lorenzo ..... B28B 7/007 52/250
2007/0028541 A1 * 2/2007 Pasek ..... B28B 19/0046 52/250
2009/0000240 A1 * 1/2009 Smalley, III ..... E04B 1/14 52/741.13
2010/0058700 A1 * 3/2010 LeBlang ..... E04B 1/165 52/506.05
2010/0198414 A1 * 8/2010 Kroll ..... F24D 3/14 700/278
2010/0257805 A1 * 10/2010 Di Lorenzo ..... E04C 2/382 52/477
2012/0304563 A1 * 12/2012 Hou ..... E04B 1/161 52/236.8
2013/0192156 A1 * 8/2013 Tims ..... E04B 2/26 52/404.2
2013/0326986 A1 * 12/2013 Krivtsov ..... E04B 2/40 52/479
2014/0087158 A1 * 3/2014 Ciuperca ..... B32B 7/02 428/215
2014/0144091 A1 * 5/2014 Neil ..... E04B 1/161 52/220.1
2014/0260034 A1 * 9/2014 Ciuperca ..... E04C 2/296 52/405.3
2015/0275499 A1 * 10/2015 Lubberts ..... E04B 1/043 52/281
2016/0369501 A1 * 12/2016 Meza ..... E04B 2/84

FOREIGN PATENT DOCUMENTS

| | | | |
|---|---|---|---|
| CN | 102852224 | A | 1/2013 |
| GB | 165466 | A | 7/1921 |
| VN | 55516 | A | 1/2018 |
| WO | 1998045545 | A1 | 10/1998 |

* cited by examiner

FAST CONSTRUCTION OF ENERGY-EFFICIENT BUILDINGS

CROSS-REFERENCE TO RELATED APPLICATIONS

The present application claims priority to Israel Patent Application 253294, entitled "Fast construction of energy-efficient buildings," filed Jul. 3, 2017, and additionally claims the benefit of U.S. Provisional Application 62/456,143, entitled "Construction system," filed Feb. 8, 2017. The respective disclosures of the aforementioned applications are incorporated herein by reference. The present application is also related to an international patent application PCT/IB2017/058437, entitled "Fast construction of energy-efficient buildings" filed Dec. 27, 2017.

FIELD OF THE INVENTION

The present invention relates to the field of construction, and particularly to the construction of multi-level (or "multi-story") buildings.

BACKGROUND

US Patent Application Publication 2012/0304563 describes a spatial light steel frame concrete building and a method for constructing the same. The building comprises: a wall spatial light steel frame; a floor slab spatial light steel frame connected to the wall spatial light steel frame to form a building unit spatial light steel frame; and concrete poured in the building unit spatial light steel frame. The wall spatial light steel frame and the floor slab spatial light steel frame each comprise a welded mesh reinforcement, and a plurality of trellis profile steels spaced apart from each other and each having a plurality of stretching holes. Each trellis profile steel comprises two wing edges parallel to each other and a plurality of web members between the wing edges which are integrally formed, the stretching holes are defined by the web members, and the web members and the stretching holes are formed by stretching the wing edges.

US Patent Application Publication 2013/0326986 describes a system and method for light steel frame construction which utilizes a single type of material for panels and fill. The system and method for light steel frame construction generally includes a light steel frame to which is secured a plurality of outer block panels and inner block panels via fasteners. Each of the block panels is made of a porous concrete mix which is pre-cured and cut to form the rectangular panels. Gaps between the outer and inner block panels is filled with a fill material, the fill material being formed of a dry mix porous concrete which is mixed with water on-site and pumped into the gaps before being allowed to expand and cure. Adhesive materials may be applied to the panels to fill gaps and secure the panels to each other.

International Patent Application Publication WO/1998/045545 describes a plate-like wall structure or wall component which comprises: outer surfaces and, between them, loadbearing frame members made up of sheet metal profiles, the frame members having flanges and, connecting them, a web in the orientation of the thickness of the structure or the component; as well as a stiff thermally insulating composite material in which the principal binding agent is a hydraulically hardening inorganic mix and which fills the spaces between the metal profiles and is bonded to these profiles. Each frame member in this wall structure or wall component consists of a thermal profile the web and flanges of which are made up of one bent sheet metal piece and which comprises in its web thermal perforation reducing the conduction of heat. All of those side edges of the wall structure or wall component which are transverse to the plate orientation are made up of the thermal profiles, and the thermally insulating composite material is a thermal concrete the aggregate in which is in the main made up of hollow particles.

SUMMARY OF THE INVENTION

There is provided, in accordance with some embodiments of the present invention, a method that includes arranging one or more frames and one or more boards, such that the frames, together with the boards, enclose a space, and pouring first concrete into the space. The method further includes, after the first concrete solidifies, within the space, into a structure, removing the boards from the structure. The method further includes pouring second concrete over the frames, such that the second concrete solidifies, over the frames, into respective walls that are adjacent to the structure.

In some embodiments, the method further includes reinforcing the first concrete.

In some embodiments, a composition of the second concrete is different from a composition of the first concrete.

In some embodiments, the second concrete includes thermal concrete.

In some embodiments, the structure includes a supporting column of a building.

In some embodiments, the structure includes a supporting wall of a building.

In some embodiments, the frames include two frames, and arranging the frames includes arranging the two frames perpendicularly to one another.

In some embodiments, the frames include two frames, and arranging the frames includes arranging the two frames in line with one another.

In some embodiments, the frames include respective vertical end-panels, and arranging the frames includes arranging the frames such that the vertical end-panels, together with the boards, enclose the space.

In some embodiments, pouring the first concrete includes pouring the first concrete such that the first concrete solidifies onto respective ends of the frames.

In some embodiments, pouring the second concrete includes pouring the second concrete after the first concrete solidifies into the structure.

In some embodiments, pouring the second concrete includes pouring the second concrete over the frames together with the structure.

In some embodiments, the method further includes:

while the first concrete solidifies into the structure, overlaying an inner side of each of the frames with an inner overlaying material, and overlaying an outer side of each of the frames with an outer overlaying material, and pouring the second concrete includes pouring the second concrete between the inner overlaying material and the outer overlaying material.

In some embodiments, the method further includes, prior to pouring the second concrete over each one of the frames, arranging a layer of overlaying material at a distance from an outer side of the frame, and pouring the second concrete includes pouring the second concrete between the frame and the layer of the overlaying material.

In some embodiments, the method further includes, prior to arranging the layer of the overlaying material, overlaying the outer side of the frame with at least one plastic sheet, and pouring the second concrete between the frame and the layer of the overlaying material includes pouring the second concrete between the frame and the layer of the overlaying material by pouring the second concrete between the frame and the plastic sheet, such that the plastic sheet interposes between the second concrete and the layer of the overlaying material.

In some embodiments, the method further includes, by pouring the second concrete between the frame and the plastic sheet, causing the plastic sheet to contact the layer of the overlaying material.

In some embodiments, the plastic sheet is shaped to define a plurality of protrusions, and causing the plastic sheet to contact the layer of the overlaying material includes causing the protrusions to contact the layer of the overlaying material, without causing other portions of the plastic sheet to contact the layer of the overlaying material.

In some embodiments, the plastic sheet includes high-density polyethylene (HDPE).

In some embodiments, arranging the layer of the overlaying material includes arranging the layer of the overlaying material at a distance of between 5 and 25 cm from the frames.

In some embodiments, the overlaying material includes stone.

In some embodiments, arranging the layer of the overlaying material includes arranging the layer of the overlaying material by coupling the overlaying material to a plurality of pins extending from the frame.

In some embodiments, the method further includes coupling the pins to the frame while the first concrete solidifies into the structure.

In some embodiments, the pins are threaded, and coupling the pins to the frame includes:

coupling one or more brackets, each of which is shaped to define one or more threaded apertures, to the frame; and screwing the pins into the threaded apertures.

In some embodiments, the method further includes, after the first concrete solidifies into the structure:

arranging a layer of overlaying material at a distance from the structure; and pouring the second concrete between the structure and the layer of the overlaying material.

In some embodiments, the method further includes, prior to arranging the layer of the overlaying material, overlaying the structure with at least one plastic sheet, and pouring the second concrete between the structure and the layer of the overlaying material includes pouring the second concrete between the structure and the layer of the overlaying material by pouring the second concrete between the structure and the plastic sheet, such that the plastic sheet interposes between the second concrete and the layer of the overlaying material.

In some embodiments, arranging the layer of the overlaying material includes:

coupling one or more brackets, each of which is shaped to define one or more threaded apertures, to the structure;

screwing respective threaded pins into the threaded apertures; and coupling the overlaying material to the threaded pins.

There is further provided, in accordance with some embodiments of the present invention, a method that includes arranging a layer of overlaying material at a distance from a frame, and pouring thermal concrete between the frame and the layer of the overlaying material, such that the thermal concrete solidifies into a wall.

In some embodiments, the method further includes, prior to pouring the thermal concrete, overlaying the frame with at least one plastic sheet, and pouring the thermal concrete between the frame and the layer of the overlaying material includes pouring the thermal concrete between the frame and the layer of the overlaying material by pouring the thermal concrete between the frame and the plastic sheet, such that the plastic sheet interposes between the thermal concrete and the layer of the overlaying material.

In some embodiments, the method further includes arranging another layer of overlaying material at a distance from a solid concrete structure that is adjacent to the frame, and pouring the thermal concrete includes pouring the thermal concrete between the solid concrete structure and the other layer of the overlaying material.

In some embodiments, the method further includes, prior to pouring the thermal concrete, overlaying the solid concrete structure with at least one plastic sheet, and pouring the thermal concrete between the solid concrete structure and the other layer of the overlaying material includes pouring the thermal concrete between the solid concrete structure and the other layer of the overlaying material by pouring the thermal concrete between the solid concrete structure and the plastic sheet, such that the plastic sheet interposes between the thermal concrete and the other layer of the overlaying material.

There is further provided, in accordance with some embodiments of the present invention, a building that includes at least one structure, and one or more walls, including respective frames, that are adjacent to the structure. The structure includes first concrete that is solidified onto respective ends of the frames, and the walls further include second concrete solidified over the respective frames.

In some embodiments, the frames include respective vertical end-panels, and the first concrete is solidified onto the respective vertical end-panels.

In some embodiments, the building further includes a layer of the second concrete that is solidified over the structure.

In some embodiments, the building further includes a layer of overlaying material overlaying the layer of the second concrete.

In some embodiments, the building further includes at least one plastic sheet interposing between the layer of the second concrete and the layer of the overlaying material such as to define one or more spaces between the plastic sheet and the layer of the overlaying material.

In some embodiments, the building further includes a layer of overlaying material arranged at a distance from the frames, and the second concrete is further solidified between the layer of the overlaying material and the frames.

In some embodiments, the building further includes at least one plastic sheet interposing between the second concrete and the layer of the overlaying material such as to define one or more spaces between the plastic sheet and the layer of the overlaying material.

In some embodiments, the plastic sheet is shaped to define a plurality of protrusions that contact the layer of the overlaying material.

There is further provided, in accordance with some embodiments of the present invention, a building that includes a layer of overlaying material and a wall. The wall includes a frame, and thermal concrete solidified over the frame and between the frame and the layer of overlaying material.

In some embodiments, the building further includes at least one plastic sheet interposing between the thermal concrete and the layer of the overlaying material such as to define one or more spaces between the plastic sheet and the layer of the overlaying material.

In some embodiments, the building further includes:

a solid concrete structure that is adjacent to the frame; and another layer of the overlaying material, the thermal concrete being further solidified between the solid concrete structure and the other layer of the overlaying material.

In some embodiments, the building further includes at least one plastic sheet interposing between the thermal concrete and the other layer of the overlaying material such as to define one or more spaces between the plastic sheet and the other layer of the overlaying material.

The present invention will be more fully understood from the following detailed description of embodiments thereof, taken together with the drawings, in which:

DETAILED DESCRIPTION OF EMBODIMENTS

Overview

Figure 1:
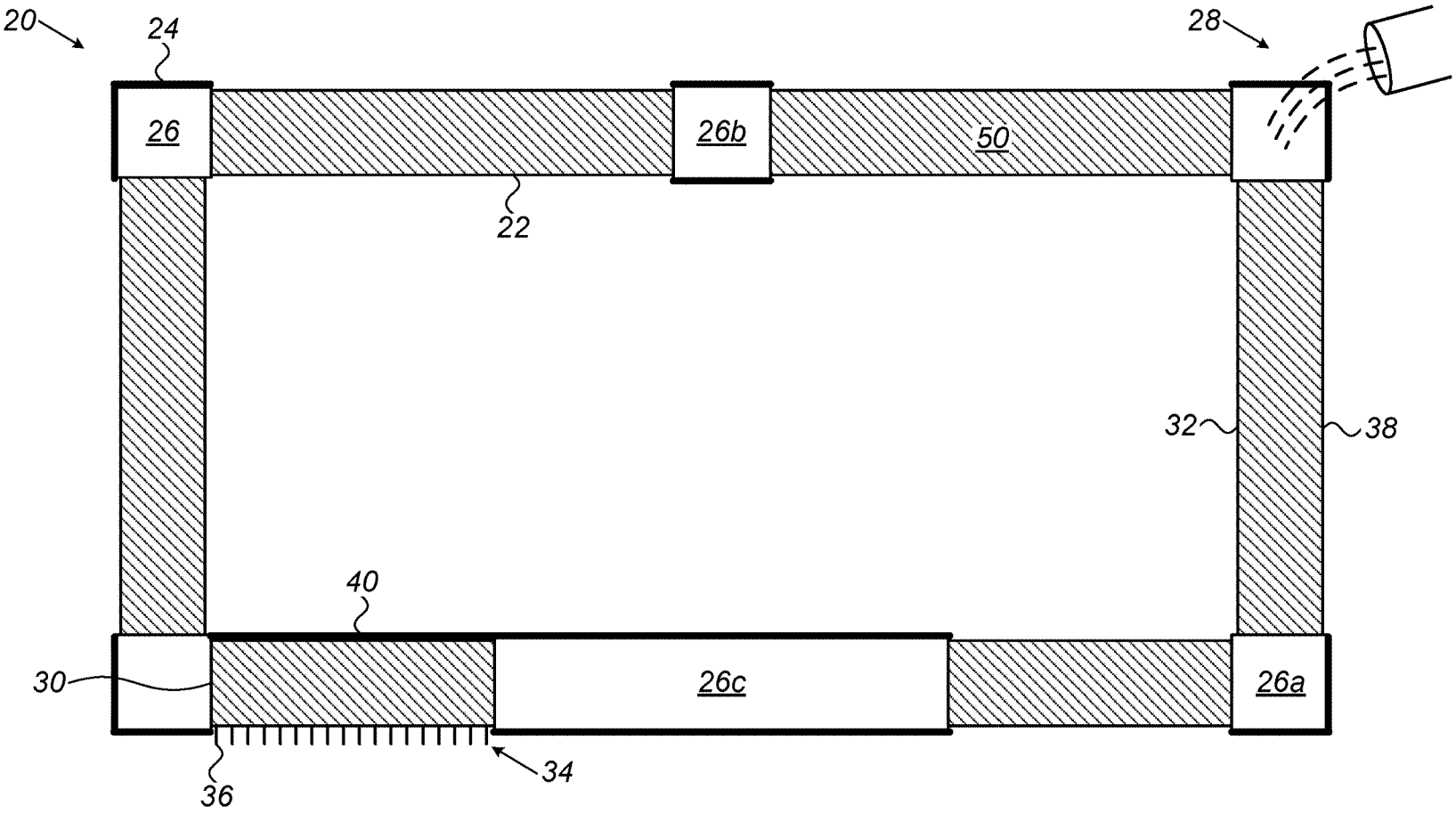
FIG. 1 is a schematic illustration of an overhead view of a level of a building under construction, in accordance with some embodiments of the present invention.

Embodiments of the present invention provide a method for the fast construction of energy-efficient structures, such as single-level or multi-level homes, apartment buildings, or office buildings.

By way of introduction, it is noted that the construction of a building, particularly a multi-level building, may involve two distinct methods of concrete casting. In one of these methods, concrete is poured (e.g., from a concrete mixer) into a temporary mold, known as "formwork." Typically, such a mold includes a plurality of vertical boards arranged to define a space therebetween, along with supports, such as metal beams, that hold the boards in place. For example, to facilitate the casting of a rectangular supporting column, four vertical boards may be arranged such as to define a space therebetween having the shape of a vertical rectangular prism, and concrete may then be poured into this space. After the concrete solidifies, the formwork is removed.

Typically, this first type of casting is used for supporting columns or supporting walls, with steel reinforcing bars, and/or other reinforcements, being used to reinforce the concrete. Hence, for ease of description, but without limiting the scope of the present disclosure, the present application refers to the solidified concrete structure produced from this first type of casting as a "supporting structure," and to the concrete used for this type of casting as "reinforced concrete." The term "formwork," as used herein, refers to the boards, and any board supports, used for constructing the mold into which the reinforced concrete is cast.

In the other casting method, concrete is poured (e.g., from a concrete mixer) over a frame, which is typically made of light steel, such that the concrete solidifies over the frame. Typically, this type of casting is used for the outer walls of the building that run between the supporting structures. In embodiments of the present invention, thermal concrete, which provides better insulation than other types of concrete, is used for each of these outer walls; hence, for ease of description, but without limiting the scope of the present disclosure, the present application refers to the solidified concrete structure produced from this second type of casting as a "thermal wall."

In embodiments of the present invention, the frames over which the thermal walls are cast comprise vertical panels at their respective ends. These vertical panels are used for the casting of the supporting structures. In particular, prior to casting a supporting structure that will be adjacent to one or more thermal walls, the respective frames for these thermal walls are placed next to the space into which the reinforced concrete will be poured, such that the panels, together with any required formwork, define a mold for the supporting structure. Subsequently, after placing any steel bars and/or other reinforcements into the mold, concrete is poured into the mold. After this reinforced concrete dries, the formwork, but not the frames, are removed from the supporting structure.

For example, for a rectangular supporting column at the southwest corner of a building, a first frame may be placed adjacent to the corner, in a north-south orientation, along the western edge of the building, and a second frame may be placed adjacent to the corner, perpendicularly to the first frame, in a west-east orientation, along the southern edge of the building. Formwork may then be placed at the corner of the building, along the western and southern edges of the building, respectively. This arrangement serves as a mold having panels for the north and east walls of the mold, and formwork boards for the west and south walls of the mold.

This technique provides at least two advantages. First, while the supporting structures solidify, work may begin on the thermal walls. In contrast, if the frames were arranged only after the supporting structures were solidified (and after the formwork were removed), work on the thermal walls would be delayed by the time required for the supporting structures to solidify, which is typically on the order of 24 hours. Hence, this technique accelerates the rate at which the building may be constructed. Second, the reinforced concrete dries onto the panels (i.e., the reinforced concrete dries such that it remains stuck to the panels), such that the panels (and the rest of the frames) reinforce the supporting structures.

In some embodiments, prior to pouring thermal concrete over the frames, the material, such as the stone, wood, or other cladding material that will overlay the thermal walls is spaced at a small distance (e.g., 5-25 cm) from the frames. Hence, the thermal concrete, upon solidifying, provides an insulating layer between the frames and the overlaying material. This insulating layer helps reduce the transfer of heat, known as "thermal bridging," via the frames. Alternatively or additionally, after the supporting structures solidify, the overlaying material may be spaced at a small distance (e.g., 5-25 cm) from the supporting structures, and thermal concrete may then be poured into this space. This layer of thermal concrete helps prevent thermal bridging via the supporting structures. Thus, the building is more energy-efficient, in that less energy is required for maintaining the interior of the building at the desired temperature.

In some embodiments, a plastic sheet, such as a sheet of high-density polyethylene (HDPE), is disposed between the frames and the overlaying material, and/or between the supporting structures and the overlaying material. For example, prior to arranging the overlaying material, the plastic sheet may be placed over the frames and/or the supporting structures, and the overlaying material may then be arranged over the plastic. Subsequently, thermal concrete may be poured behind the plastic sheet, such that the plastic sheet separates the thermal concrete from the overlaying material. Advantageously, the interposing plastic sheet may obviate the need to waterproof the overlaying material and/or seal the joints between the individual overlaying-material elements, since, even if some moisture seeps behind the overlaying material, this moisture won't reach the thermal concrete. Moreover, any gaps between the plastic and the overlaying material may provide thermal and acoustic insulation.

In some embodiments, which combine all of the above-described techniques, the outer walls of a building are constructed, level-by-level, as follows:

(i) The formwork is arranged together with the frames, such that the frames, together with the formwork, define the molds for the supporting structures.

(ii) Reinforced concrete is poured into the molds.

(iii) While the reinforced concrete dries, the inner sides of the frames are overlaid with suitable inner-wall material (e.g., cement board or drywall), the frames are reinforced, a concrete ceiling is cast over the frames, a plastic sheet is laid over the outer side of the frames, and successive horizontal rows of spacers (such as threaded pins) are then coupled to the outer side of the frames, such that the spacers hold the plastic in place.

(iv) Following the drying of the reinforced concrete:

(a) The formwork is removed.

(b) The plastic sheet is extended over the reinforced concrete.

(c) Successive horizontal rows of spacers are coupled to the reinforced concrete, in line with the rows of spacers that are coupled to the frames, such that the spacers hold the plastic in place.

(d) Successive rows of overlaying material (such as stone) are coupled to the spacers and, following the coupling of each of these rows, thermal concrete is poured into the space behind the plastic, covering both the frames and the reinforced concrete.

Method Description

Reference is initially made to FIG. 1, which is a schematic illustration of an overhead view of a level of a building 20 under construction, in accordance with some embodiments of the present invention.

Typically, the construction of each level of building 20 begins with the arrangement of frames 22 and formwork 24, such that frames 22, together with formwork 24, enclose (i.e., surround) various spaces 26 into which reinforced concrete may be poured. (For simplicity, only the boards of formwork 24 are shown in the figures.) For example:

(i) To facilitate the casting of a rectangular supporting column at the corner of the building, two frames 22 may be arranged perpendicularly to one another (e.g., as described above in the Overview), such that respective ends 30 of the frames demarcate the future respective locations of two adjoining faces of the column. Two formwork boards may be placed opposite ends 30, such as to demarcate the future respective locations of the other two faces of the column. This configuration of frames and formwork encloses a space 26*a* having the shape of a rectangular column.

(ii) To facilitate the casting of a rectangular supporting column at any non-corner location along a wall of the building, two frames 22 may be arranged in line with one another, such that respective ends 30 of the frames demarcate the future respective locations of two opposite faces of the column. Two formwork boards may be placed perpendicularly to ends 30, such as to demarcate the future respective locations of the other two faces of the column. This configuration of frames and formwork encloses a space 26*b* having the shape of a rectangular column.

(iii) To facilitate the casting of a rectangular supporting wall, two frames, and two formwork boards, may be arranged as described above for the rectangular supporting column, but with a larger distance between the respective ends of the two frames. Such an arrangement encloses a space 26*c* having the shape of a rectangular supporting wall.

Typically, as described below with reference to FIG. 2, ends 30 of frames 22 comprise respective vertical end-panels, which may have similar dimensions to those of the boards of formwork 24. These vertical end-panels, together with the formwork, enclose spaces 26.

Following the arrangement of the frames and formwork, reinforced concrete 28 is poured into spaces 26. This concrete solidifies into structures having the respective shapes of spaces 26. Typically, the concrete solidifies onto the respective ends of the frames (e.g., onto the respective vertical end-panels of the frames), such that the structures are attached to, and hence reinforced by, the frames. Following the solidifying of the concrete, formwork 24 (but not frames 22) are removed from the structures.

Although frames 22 typically comprise light steel, it is noted that frames 22 may comprise any suitable type of metal, or any other suitable type of material. Similarly, although the boards of formwork 24 typically comprise wood, it is noted that these boards may alternatively comprise any other suitable type of material, such as plastic, fiber cement, or gypsum board ("drywall"). Formwork 24 may comprise any suitable board supports (such as board-supporting light-steel structures) configured to hold the boards in place while the reinforced concrete solidifies.

Notwithstanding the particular arrangements of frames and formwork shown in FIG. 1 and described above, it is noted that the scope of the present invention includes any suitable arrangement of frames and formwork, for the casting of any type of structure (supporting or otherwise) having any suitable shape, whether along the exterior of the building or within the interior of the building.

Typically, while the reinforced concrete solidifies, further construction, or preparation for further construction, is performed. For example, the inner side 32 of each of frames 22 (i.e., the interior-facing side of each of the frames) may be overlaid with any suitable inner overlaying material (or "inner-wall material) 40, such as cement board or drywall. Alternatively or additionally, the frames may be reinforced, and/or a concrete ceiling may be cast over the upper surface 50 of the frames. Alternatively or additionally, as further described below with reference to FIG. 2, successive horizontal rows 34 of spacers 36, comprising, for example, brackets and pins, may be coupled to the outer side 38 of each of the frames (i.e., to the exterior-facing side of each of the frames).

Figure 2:
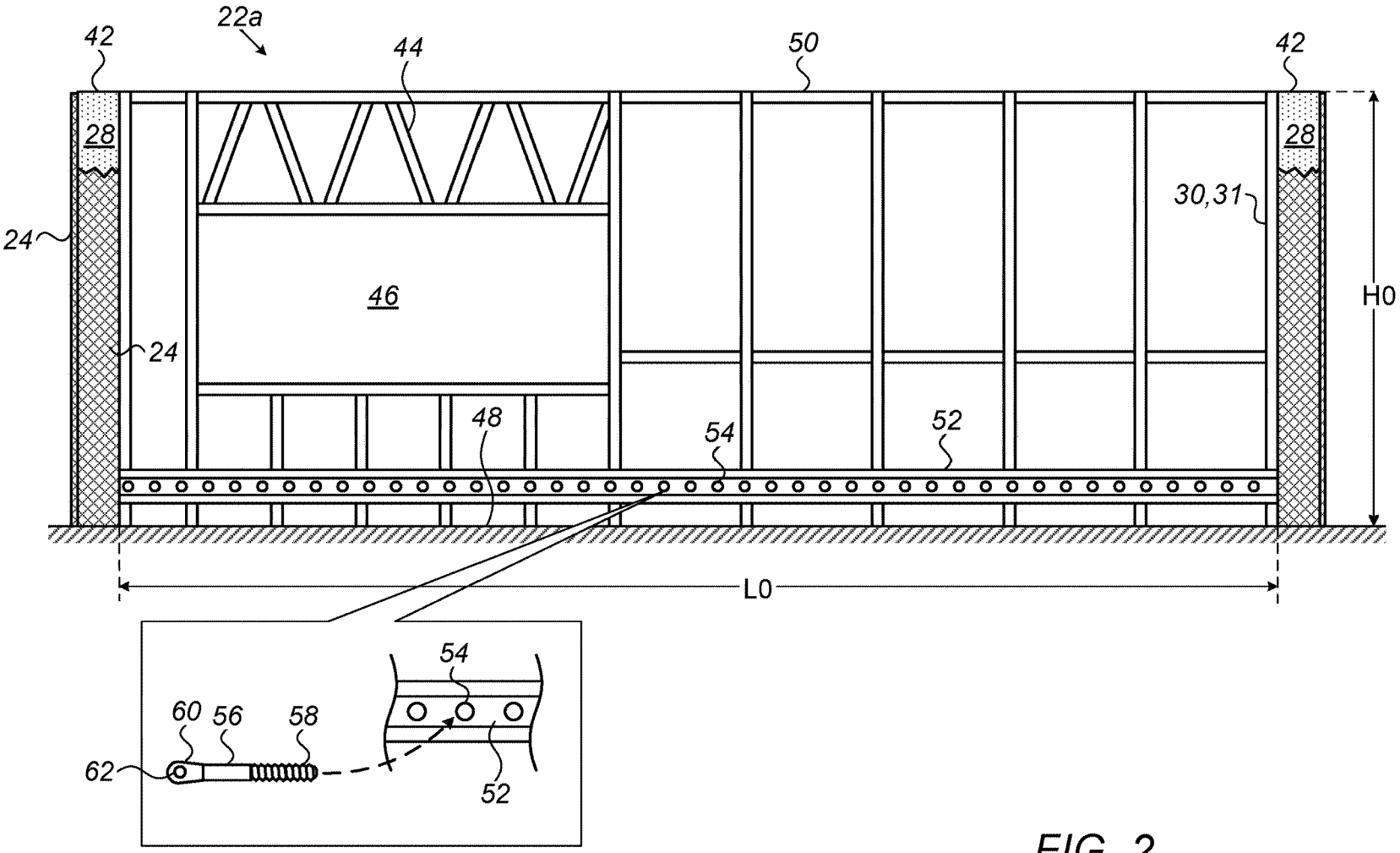
FIG. 2 is a schematic illustration of a frontal view of a light steel frame situated between two solidifying corner supporting columns, in accordance with some embodiments of the present invention.

Reference is now made to FIG. 2, which is a schematic illustration of a frontal view of a light steel frame 22*a* situated between two solidifying corner supporting columns 42, in accordance with some embodiments of the present invention.

Light steel frame 22*a*, which is an example embodiment of frames 22 (FIG. 1), typically comprises plurality of horizontal, vertical, and/or diagonal light steel members 44. Members 44 may be interconnected in any suitable configuration, e.g., such as to provide structural stability to the thermal concrete that is poured over the frame, and/or to define any desired features of the thermal wall, such as windows 46. Typically, frame 22*a* has a length L0 of at least 60 cm, and a height H0 of at least 1 m. Frame 22*a* may stand on any suitable bottom surface 48, such as a concrete foundation, or a concrete ceiling of a lower level.

(Notwithstanding the particular features of light steel frame 22*a* described above, it is noted that the techniques described below with reference to light steel frame 22*a* may be similarly practiced using other types of frames.)

As described above with reference to FIG. 1, supporting columns 42 are formed by casting concrete 28 in a mold comprising vertical end-panels 31 of frame 22*a*, along with formwork 24. (For clarity, in FIG. 2, a top portion of each of the frontal formwork boards is removed, such as to expose concrete 28.) As further described above with reference to FIG. 1, while concrete 28 solidifies, various construction-related tasks may be performed. For example, a concrete ceiling (not shown) may be cast over the upper surface 50 of the steel frame. Alternatively or additionally, one or more brackets 52, such as omega brackets, each of which is shaped to define one or more threaded apertures 54, may be coupled to the frame. Subsequently, while concrete 28 continues to solidify, threaded pins 56 may be screwed into brackets 52. As further described below with reference to FIGS. 3A-B, subsequently to concrete 28 solidifying, overlaying material may be coupled to threaded pins 56. Threaded pins 56 and brackets 52 thus together embody spacers 36 (FIG. 1), in that the pins and brackets facilitate spacing the overlaying material from the frame.

In some embodiments, each of brackets 52 is longitudinally shaped, having a length that is at least twice as large, and is typically at least three, four, or five times as large, as the width of the bracket. (For example, the length of the bracket may be equal to L0.) In such embodiments, each of brackets 52 is typically shaped to define a single row of threaded apertures 54, and is coupled to frame 22*a* in a horizontal orientation. (Not every aperture 54 necessarily receives a threaded pin.)

In some embodiments, each of threaded pins 56 comprises a threaded tail 58, which screws into aperture 54, and a head 60, coupled to tail 58, which is shaped to define a pin-aperture 62. As further described below with reference to FIGS. 3A-B, slabs of stone may be coupled to pins 56, by passing other pins through pin-apertures 62 and into the stone slabs.

Figure 3A:
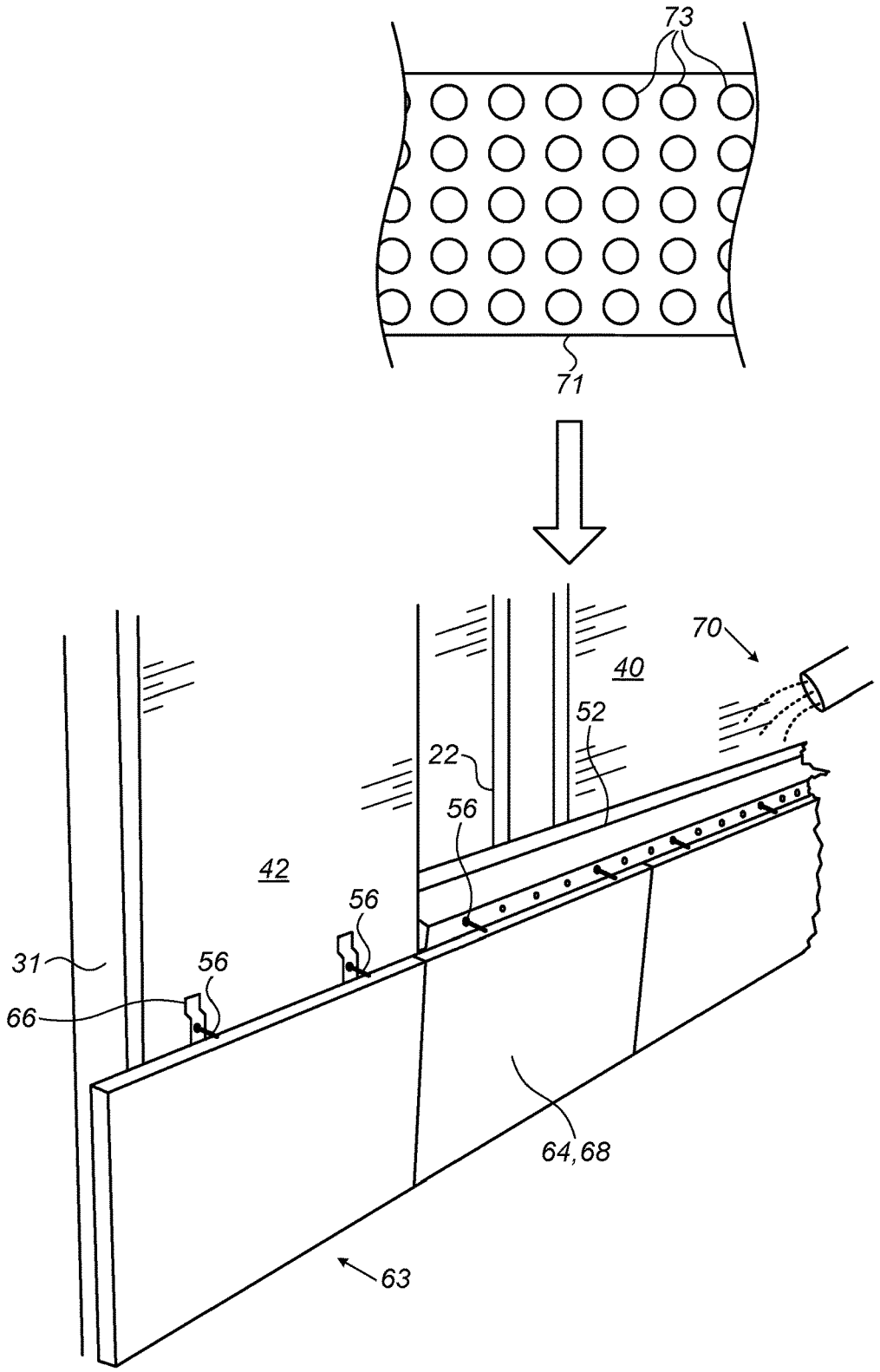
FIGS. 3A-B are schematic illustrations of overlaying material coupled to a supporting column and a frame, in accordance with some embodiments of the present invention.
Figure 3B:
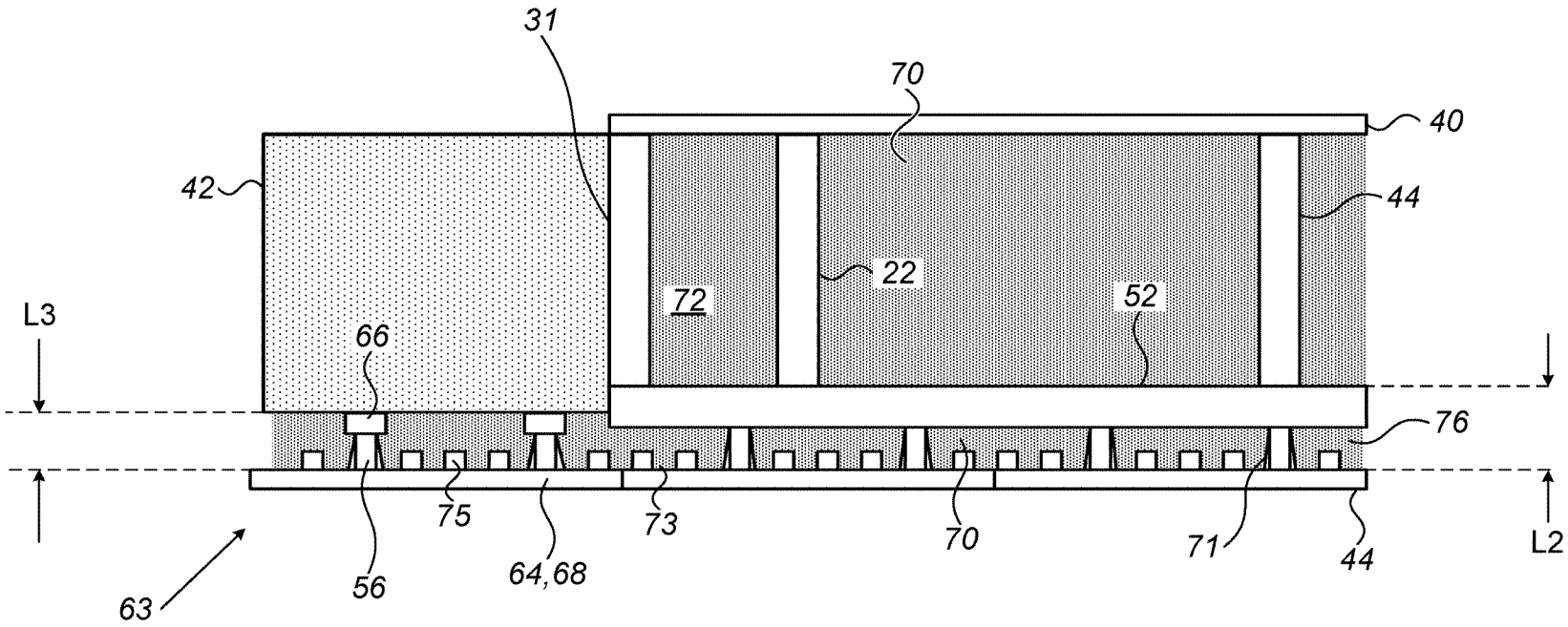

Reference is now made to FIGS. 3A-B, which are schematic illustrations of overlaying material 64 coupled to a supporting column 42 and a frame 22, in accordance with some embodiments of the present invention. (Since column 42 is an example of a supporting structure, the term "supporting structure," or simply "structure," may be used herein interchangeably with the term "column.") FIG. 3B generally shows an overhead view of the scenario depicted in FIG. 3A, without showing the upper surface of frame 22.

Typically, following the solidifying of the supporting structures, one or more brackets 66 are coupled to the supporting structures. For example, holes may be drilled in the supporting structures, and then anchors may be passed through the brackets and into the holes, such that the anchors anchor the brackets to the supporting structures. Each of brackets 66 is typically shaped to define one or more threaded apertures (e.g., exactly one threaded aperture), which may be similar or identical to threaded apertures 54 in brackets 52. Brackets 66 are typically coupled to the supporting structures such that the threaded apertures in brackets 66 are in line with threaded apertures 54 in brackets 52. Subsequently, threaded pins 56 are screwed into the threaded apertures of brackets 66 (along with the threaded apertures of brackets 52, if this was not already done). A layer 63 of overlaying material 64 (which may be referred to as "outer overlaying material," to distinguish from inner overlaying material 40) is then arranged over the outer side of the supporting structures and frames 22, at a distance from the supporting structures and frames, by coupling overlaying material 64 to the threaded pins.

In some embodiments, as illustrated in FIG. 3A, overlaying material 64 comprises stone, e.g., in the form of a plurality of stone slabs 68. In such embodiments, stone slabs 68 may be hung from pins 56, and/or supported from below by pins 56, by passing other pins through pin-apertures 62 (FIG. 2) and into the stone slabs. (For example, as illustrated in FIGS. 3A-B, each slab 68 may be hung from a respective pair of pins 56.) Alternatively, overlaying material 64 may comprise any other material, such as wood, and/or overlaying material 64 may be coupled to pins 56 in any other suitable way.

Typically, overlaying material 64 is arranged one row at a time, beginning with the lowermost row of the wall, which is closest to bottom surface 48 (FIG. 2). (The portion of the lowermost row that overlays the frames may be arranged while the supporting structures are solidifying.) After the arrangement of each row, thermal concrete 70 is poured over the frames, i.e., thermal concrete 70 is poured into the space 72 between outer overlaying material 64 and inner overlaying material 40 (which includes a space 76 between frames 22 and overlaying material 64), such that the thermal concrete covers the frames. Thermal concrete 70 thus solidifies, over frames 22, into respective thermal walls that are adjacent to the supporting structures. Advantageously, due the existence of space 76, a heat-transfer-inhibiting layer of thermal concrete solidifies over the frames. Thermal concrete 70 is also poured into the space 74 between overlaying material 64 and the supporting structures, such that thermal concrete 70 solidifies into a heat-transfer-inhibiting layer over the supporting structures.

Typically, thermal concrete 70 is poured (e.g., from a concrete mixer) over the frames together with the supporting structures, following the solidification of the supporting structures. (In other words, typically, a single pouring of thermal concrete covers at least part of at least one frame and at least part of at least one supporting structure.) It is noted, however, that thermal concrete may be poured over the frames separately from being poured over the supporting structures; alternatively, thermal concrete may not be poured over the supporting structures at all. In such embodiments, it may be possible to cast the thermal walls even before the supporting structures solidify.

Typically, space 76 (which extends underneath and above brackets 52, reaching the members 44 that define the main body of each frame) has a length L2 that is between 5 and 25 cm, such that layer 63 is arranged at a distance of between 5 and 25 cm from frames 22. Typically, the overlaying material that covers the supporting structures is in line with the overlaying material that covers any neighboring frames. Thus, the length L3 of space 74 is also, typically, between 5 and 25 cm. (If, as shown in FIGS. 3A-B, brackets 52 extend slightly past the supporting structures, length L3 may be slightly less than length L2.)

(In general, in the context of the present application, including the claims, one item may be said to "overlay" another item, even if the two items are not in contact with one another. Thus, for example, even though overlaying material 64 does not, typically, contact the frames or supporting structures, this material may nonetheless be referred to as "overlaying" the frames and supporting structures, in that this material overlays the thermal concrete that in turn overlays the frames and supporting structures.)

In many cases, multiple walls of the building are cast at once. For example, for the rectangular building shown in FIG. 1, each row of overlaying material may overlay, contiguously, the entire perimeter of the building, such that all four sides of the building are covered (in part) by a single pouring of thermal concrete. In other cases, one or more of the walls may be cast separately from the other walls.

Notwithstanding the example embodiments shown in FIG. 2 and FIGS. 3A-B, it is noted that, in general, layer 63 of overlaying material 64 may be arranged in any suitable way, such as to define a space between (i) the supporting structures, and/or frames 22, and (ii) layer 63. For example, instead of brackets and pins, other types of spacing elements that embody spacers 36 (FIG. 1), such as rods, nails, or other types of screws or pins, may be used to mount the overlaying material at a suitable distance (e.g., 5-25 cm) from the frames and supporting structures. Such spacing elements may be coupled to the frames using any suitable technique.

As yet another alternative, spacers 36 may be manufactured as an integral part of frames 22. For example, frames 22 may be shaped to define outward-pointing pins and/or other projections, which may have heads similar to heads 60 of pins 56 to facilitate the mounting of stone slabs 68, or may have any other suitable shape. In such embodiments, overlaying material 64 is spaced from the main body of each frame (which comprises members 44), by virtue of being mounted onto the projections. Such embodiments may further reduce the time required for construction, or at least reduce the cost of construction, by obviating the need to attach brackets, pins, or any other spacing elements to the frames while the reinforced concrete solidifies.

It is noted that the spacing of the overlaying material from the frames and supporting structures may be practiced independently from the use of the frames for the casting of the supporting structures. Similarly, the use of the frames for the casting of the supporting structures may be practiced independently from the spacing of the overlaying material. Moreover, the overlaying material may be spaced from the frames without being spaced from the supporting structures, or vice versa. The type of overlaying material used to overlay the frames need not necessarily be the same as the type of overlaying material used to overlay the supporting structures.

It is further noted that the concrete poured into the molds may have any suitable composition, and may have any suitable strength, such as any strength between B20 and B60. Furthermore, any suitable type of concrete, which does not necessarily include thermal concrete, may be poured over the frames. This concrete may have the same composition, or a different composition, from the concrete that is poured into the molds.

In some embodiments, at least one plastic sheet 71, comprising, for example, high-density polyethylene (HDPE), interposes between thermal concrete 70 and layer 63. Typically, plastic sheet 71 is at least partly in contact with layer 63, such that layer 63 provides structural support to the thermal concrete. Advantageously, as noted above in the Overview, plastic sheet 71 may protect the thermal concrete from moisture.

Typically, plastic sheet 71 is in partial contact, but not full contact, with layer 63. In other words, plastic sheet 71 is typically shaped, and/or positioned, such as to define one or more spaces (or "gaps") 75 between plastic sheet 71 and layer 63. For example, plastic sheet 71 may be shaped to define a plurality of protrusions 73, which contact the layer of overlaying material such that the other portions of the plastic sheet remain separated from the layer of overlaying material by spaces 75. (For example, plastic sheet 71 may comprise an embossed geomembrane.) As noted above in the Overview, spaces 75 may provide thermal and acoustic insulation to the building.

Typically, prior to arranging the layer of overlaying material over each one of the frames, the outer side of the frame is overlaid with plastic sheet 71. For example, prior to screwing threaded pins 56 into brackets 52, plastic sheet 71 may be laid over brackets 52. Next, threaded pins 56 may be passed through the plastic sheet and screwed into brackets 52, such that threaded pins 56 couple the plastic sheet to the frame. Subsequently, thermal concrete 70 may be poured behind plastic sheet 71, causing protrusions 73 (but not the other portions of the plastic sheet) to contact the layer of overlaying material, by virtue of the thermal concrete pushing the plastic sheet outward, toward the layer of overlaying material. Three advantages are thus obtained: (i) the overlaying material supports the thermal concrete, by virtue of being in contact with protrusions 73, (ii) the plastic sheet protects the thermal concrete from any outside moisture, and (iii) spaces 75 insulate the building from heat and noise.

In some embodiments, as illustrated in FIG. 3B, structure is also overlaid by plastic. For example, following the solidifying of structure 42, the end of the plastic sheet that was already coupled to frame 22 may be pulled over the structure, and threaded pins 56 may then be passed through the plastic sheet and screwed into the threaded apertures of brackets 66, such that the threaded pins hold the plastic sheet to the structure. Subsequently, following the arrangement of each row of overlaying material, thermal concrete may be poured behind the plastic, over both frame 22 and structure 42. In other embodiments, only frames 22, but not structures 42, are overlaid by plastic sheet 71.

Figure 4:
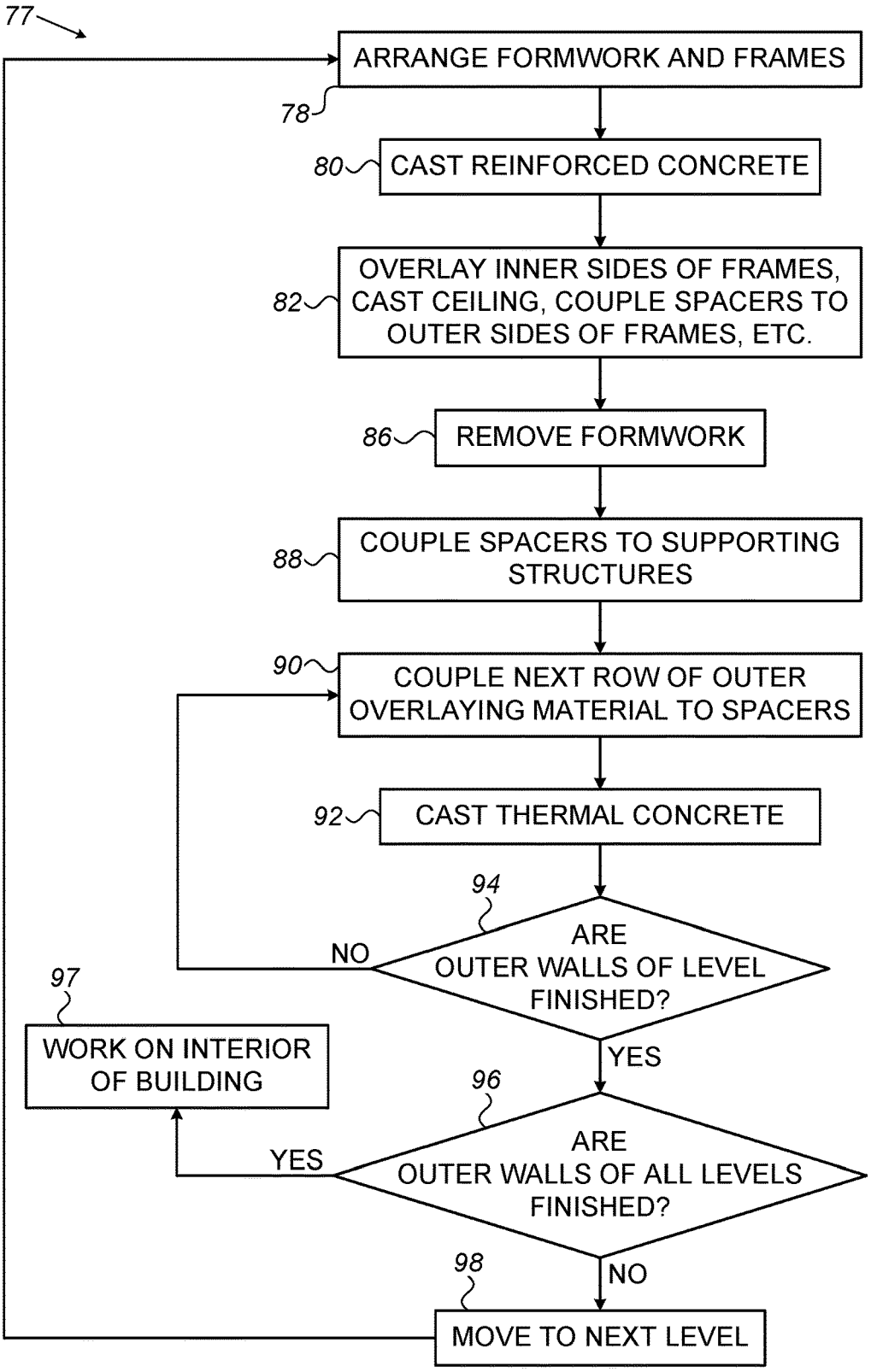
FIG. 4 is a flow diagram for a method for building a multi-level building, in accordance with some embodiments of the present invention.

Reference is now made to FIG. 4, which is a flow diagram for a method 77 for building a multi-level building, in accordance with some embodiments of the present invention.

First, in an arranging step 78, the formwork and frames are arranged, as described above with reference to FIG. 1, such as to define one or more molds for the casting of reinforced concrete. Subsequently, at a reinforced-concrete-casting step 80, reinforced concrete is cast into these molds. Subsequently, while the reinforced concrete solidifies, at a building step 82, various building operations may be performed. For example, the inner sides of the frames may be overlaid with suitable inner-wall material, such as drywall, the ceiling may be cast, plastic sheets 71 may be placed over the frames, and spacers, such as brackets and pins, may be coupled to the outer sides of the frames. Subsequently, following the solidification of the supporting structures, the formwork is removed, at a formwork-removing step 86. Next, at a spacer-coupling step 88, spacers, such as brackets and pins, are coupled to the supporting structures. (Prior to coupling the spacers, plastic sheets 71 may be placed over the supporting structures.)

Following spacer-coupling step 88, at an overlaying step 90, a row of outer overlaying material, such as stone, is coupled to the spacers. Next, at a thermal-concrete-casting step 92, thermal concrete is cast over the frames and into the space between the frames and the outer overlaying material. Subsequently, at a first checking step 94, the builder checks if the outer walls of the current level are finished. If not, the builder returns to overlaying step 90, at which the builder overlays the next row of overlaying material, and then to thermal-concrete-casting step 92. The builder may thus build the outer walls of the building, one horizontal slice at a time. (In some embodiments, spacer-coupling step 88 is performed as part of this iterative operation, i.e., each row of spacers is coupled to the supporting structures immediately prior to the coupling of a row of overlaying material to the spacers.)

If, at first checking step 94, the builder ascertains that the outer walls of the level are finished, the builder, at a second checking step 96, checks if the outer walls of all of the levels are finished. If not, the builder, following the solidification of the ceiling over the level, moves to the next level of the building, at a level-increasing step 98. In particular, the formwork is moved to the next level, and new frames are placed on the new level. These new frames, along with the formwork, are then arranged at arranging step 78. (Arranging step 78 may take place at the new level, even before the thermal concrete in the preceding level has dried.)

Once the outer walls of all of the levels are finished, the builder proceeds to work on the interior of the building, at an interior-work step 97. (It is noted that some of the interior work may have already been performed at building step 82.)

It will be appreciated by persons skilled in the art that the present invention is not limited to what has been particularly shown and described hereinabove. Rather, the scope of embodiments of the present invention includes both combinations and subcombinations of the various features described hereinabove, as well as variations and modifications thereof that are not in the prior art, which would occur to persons skilled in the art upon reading the foregoing description. Documents incorporated by reference in the present patent application are to be considered an integral part of the application except that to the extent any terms are defined in these incorporated documents in a manner that conflicts with the definitions made explicitly or implicitly in the present specification, only the definitions in the present specification should be considered.

The invention claimed is:

1. A method, comprising:

arranging one or more frames and one or more boards, such that the one or more frames, together with the one or more boards, enclose a space;

pouring first concrete into the space, and subsequently allowing the first concrete to solidify within the space, thereby forming a structure;

while the first concrete solidifies within the space, overlaying respective inner sides of the one or more frames with an inner overlay of an inner overlaying material;

overlaying respective outer sides of the one or more frames with an outer overlay of an outer overlaying material;

after the first concrete solidifies within the space, removing the one or more boards from the structure;

pouring second concrete over the one or more frames, between the inner overlay and the outer overlay; and subsequently to pouring the second concrete, allowing the second concrete to solidify over the one or more frames, thereby forming respective walls that are adjacent to the structure.

2. The method according to claim 1, further comprising reinforcing the first concrete.

3. The method according to claim 1, wherein a composition of the second concrete is different from a composition of the first concrete.

4. The method according to claim 1, wherein the second concrete includes thermal concrete.

5. The method according to claim 1, wherein the structure includes a supporting column of a building.

6. The method according to claim 1, wherein the structure includes a supporting wall of a building.

7. The method according to claim 1, wherein the one or more frames include two frames, and wherein arranging the one or more frames comprises arranging the two frames perpendicularly to one another.

8. The method according to claim 1, wherein the one or more frames include two frames, and wherein arranging the one or more frames comprises arranging the two frames in line with one another.

9. The method according to claim 1, wherein the one or more frames comprise respective vertical end-panels, and wherein arranging the one or more frames comprises arranging the one or more frames such that the vertical end-panels, together with the one or more boards, enclose the space.

10. The method according to claim 1, wherein allowing the first concrete to solidify comprises allowing the first concrete to solidify onto respective ends of the one or more frames.

11. The method according to claim 1, wherein pouring the second concrete comprises pouring the second concrete after the first concrete solidifies.

12. The method according to claim 11, wherein pouring the second concrete comprises pouring the second concrete over the one or more frames together with the structure.

13. The method according to claim 1, wherein overlaying the respective outer sides of the one or more frames with the outer overlay comprises overlaying the respective outer sides by arranging the outer overlay at a distance from the respective outer sides of the one or more frames, and wherein pouring the second concrete comprises pouring the second concrete between the one or more frames and the outer overlay.

14. The method according to claim 13, wherein the distance is between 5 and 25 cm.

15. The method according to claim 13, further comprising, prior to arranging the outer overlay, overlaying the respective outer sides of the one or more frames with respective plastic sheets, wherein pouring the second concrete between the one or more frames and the outer overlay comprises pouring the second concrete between the one or more frames and the outer overlay by pouring the second concrete between the frame one or more frames and the plastic sheets, such that the plastic sheets interpose between the second concrete and the outer overlay.

16. The method according to claim 15, wherein the plastic sheets include high-density polyethylene (HDPE).

17. The method according to claim 15, further comprising, by pouring the second concrete between the one or more frames and the plastic sheets, causing the plastic sheets to contact the outer overlay.

18. The method according to claim 17, wherein each of the plastic sheets is shaped to define a plurality of protrusions, and wherein causing the plastic sheets to contact the outer overlay comprises causing the protrusions to contact the outer overlay without causing other portions of the plastic sheets to contact the outer overlay.

19. The method according to claim 1, wherein the outer overlaying material comprises stone.

20. The method according to claim 1, wherein overlaying the respective outer sides of the one or more frames comprises overlaying the respective outer sides by coupling the outer overlay to a plurality of pins extending from the one or more frames.

21. The method according to claim 20, further comprising coupling the pins to the one or more frames while the first concrete solidifies.

22. The method according to claim 21, wherein the pins are threaded, and wherein coupling the pins to the one or more frames comprises:

coupling one or more brackets, each of which is shaped to define one or more threaded apertures, to the one or more frames; and screwing the pins into the one or more threaded apertures.

23. The method according to claim 1, further comprising, after the first concrete solidifies:

arranging a layer of the outer overlaying material at a distance from the structure; and pouring the second concrete between the structure and the layer of the outer overlaying material.

24. The method according to claim 23, further comprising, prior to arranging the layer of the outer overlaying material, overlaying the structure with at least one plastic sheet, wherein pouring the second concrete between the structure and the layer of the outer overlaying material comprises pouring the second concrete between the structure and the layer of the outer overlaying material by pouring the second concrete between the structure and the plastic sheet, such that the plastic sheet interposes between the second concrete and the layer of the outer overlaying material.

25. The method according to claim 23, wherein arranging the layer of the outer overlaying material comprises:

coupling one or more brackets, each of which is shaped to define one or more threaded apertures, to the structure;

screwing respective threaded pins into the threaded apertures; and coupling the layer of the outer overlaying material to the threaded pins.

26. A method, comprising:

arranging one or more frames and one or more boards, such that the one or more frames, together with the one or more boards, enclose a space;

pouring first concrete into the space, and subsequently allowing the first concrete to solidify within the space, thereby forming a structure;

after the first concrete solidifies within the space, removing the one or more boards from the structure;

overlaying respective outer sides of the one or more frames with respective plastic sheets;

subsequently to overlaying the respective outer sides with the respective plastic sheets, arranging an overlay of an overlaying material at a distance from the plastic sheets;

pouring second concrete over the one or more frames and behind the plastic sheets, such that the plastic sheets interpose between the second concrete and the overlay; and subsequently to pouring the second concrete, allowing the second concrete to solidify over the one or more frames, thereby forming respective walls that are adjacent to the structure.

27. The method according to claim 26, further comprising, by pouring the second concrete, causing the plastic sheets to contact the overlay.

28. The method according to claim 26, wherein the plastic sheets include high-density polyethylene (HDPE).

* * * * *